US010990048B1

(12) United States Patent
Inagaki et al.

(10) Patent No.: US 10,990,048 B1
(45) Date of Patent: Apr. 27, 2021

(54) FIXING BELT, FIXING DEVICE, AND IMAGE FORMING APPARATUS

(71) Applicant: FUJI XEROX CO., LTD., Tokyo (JP)

(72) Inventors: Tomotake Inagaki, Kanagawa (JP); Ryohei Yoshikawa, Kanagawa (JP); Ryo Sekiguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/847,948

(22) Filed: Apr. 14, 2020

(30) Foreign Application Priority Data

Nov. 1, 2019 (JP) ..... JP2019-199833

(51) Int. Cl.
*G03G 15/20* (2006.01)

(52) U.S. Cl.
CPC ..... *G03G 15/2057* (2013.01)

(58) Field of Classification Search
CPC ..... G03G 15/2053; G03G 15/2057
See application file for complete search history.

(56) References Cited

U.S. PATENT DOCUMENTS

| | | | | |
|---|---|---|---|---|
| 6,670,044 | B2 | 12/2003 | Shida et al. | |
| 2006/0263555 | A1* | 11/2006 | Iwamoto | B32B 25/08 428/36.9 |
| 2009/0232432 | A1* | 9/2009 | Egami | F16C 33/427 384/464 |
| 2009/0324959 | A1* | 12/2009 | Wu | G03G 15/2057 428/421 |
| 2018/0067429 | A1* | 3/2018 | Kikuchi | G03G 15/2057 |

FOREIGN PATENT DOCUMENTS

| | | | |
|---|---|---|---|
| JP | 2001-341231 | A | 12/2001 |
| JP | 2004-012669 | A | 1/2004 |
| JP | 2004-070191 | A | 3/2004 |
| JP | 2005-121975 | A | 5/2005 |
| JP | 2009-025565 | A | 2/2009 |
| JP | 2013-061565 | A | 4/2013 |
| WO | 2011/013221 | A1 | 2/2011 |

* cited by examiner

*Primary Examiner* — Sandra Brase
(74) *Attorney, Agent, or Firm* — Sughrue Mion, PLLC

(57) ABSTRACT

A fixing belt includes an annular resin base layer having a water absorption rate of 3% or less, a metal layer provided on the outer peripheral surface of the resin base layer, and an elastic layer provided on the outer peripheral surface of the metal layer.

13 Claims, 3 Drawing Sheets

FIXING BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2019-199833 filed Nov. 1, 2019.

BACKGROUND

(i) Technical Field

The present disclosure relates to a fixing belt, a fixing device, and an image forming apparatus.

(ii) Related Art

An image forming apparatus (a copying machine, a facsimile, a printer, or the like) using an electrophotographic system forms images by fixing toner images, formed on a recording material, by using a fixing device provided with a fixing belt.

For example, International Publication No. 2011/013221 discloses a fixing belt having a metal-made cylindrical substrate and a polyimide resin layer formed on the internal peripheral surface of the cylindrical substrate, the polyimide resin layer having an imidization ratio of 70% to 93%.

Also, Japanese Unexamined Patent Application Publication No. 2005-121975 discloses a fixing belt having a belt substrate including a laminate of a polyimide resin layer and a metal layer, the polyimide, which forms the polyimide resin layer, having an imidization ratio of 95% or more.

Further, Japanese Unexamined Patent Application Publication No. 2004-012669 discloses a fixing belt for electromagnetic induction heating, including a polyimide resin layer, a metal layer formed on the surface of the resin layer to generate heat by electromagnetic induction, and a release layer formed on the outermost peripheral surface, the polyimide resin layer containing an imidization product which is produced by imidizing polyamic acid in the presence of a cyclodehydrating agent and which has an imidization ratio of 95% to 100%.

Further, Japanese Unexamined Patent Application Publication No. 2013-61565 discloses an endless belt having at least one or more metal layers and a release layer provided on the metal layers, a metal material used for the metal layers having a stress of 343 $N/mm^2$ or more up to an upper yield point in a stress-strain diagram. The stress-strain diagram is measured according to JIS 22241, Metallic materials-Tensile testing, using a test piece of the metal material according to JIS 22201, Tension Test Pieces for Metallic Materials and a testing machine used for a tensile test according to JIS B7721, Tension/compression testing machines-Calibration and verification of the force-measuring system.

Further, Japanese Unexamined Patent Application Publication No. 2004-70191 discloses an endless belt having a base layer made of a synthetic resin, a metal layer laminated on the base layer, and a coating layer further laminated thereon and made of a synthetic resin, the metal layer being formed near a neutral axis where no distortion is produced when bending deformation occurs in the belt.

SUMMARY

Aspects of non-limiting embodiments of the present disclosure relate to a fixing belt having an annular resin base layer, a metal layer provided on an outer peripheral surface of the resin base layer, and an elastic layer provided on an outer peripheral surface of the metal layer. The fixing belt suppresses peeling between the resin base layer and the metal layer when toner images are repeatedly fixed after long-term storage in a high-temperature high-humidity environment, as compared with a case where the resin base layer has a water absorption rate exceeding 3%.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing belt including an annular resin base layer having a water absorption rate of 3% or less, a metal layer provided on the outer peripheral surface of the resin base layer, and an elastic layer provided on the outer peripheral surface of the metal layer.

BRIEF DESCRIPTION OF THE DRAWINGS

Exemplary embodiments of the present disclosure will be described in detail based on the following figures, wherein.

DETAILED DESCRIPTION

Figure 1:
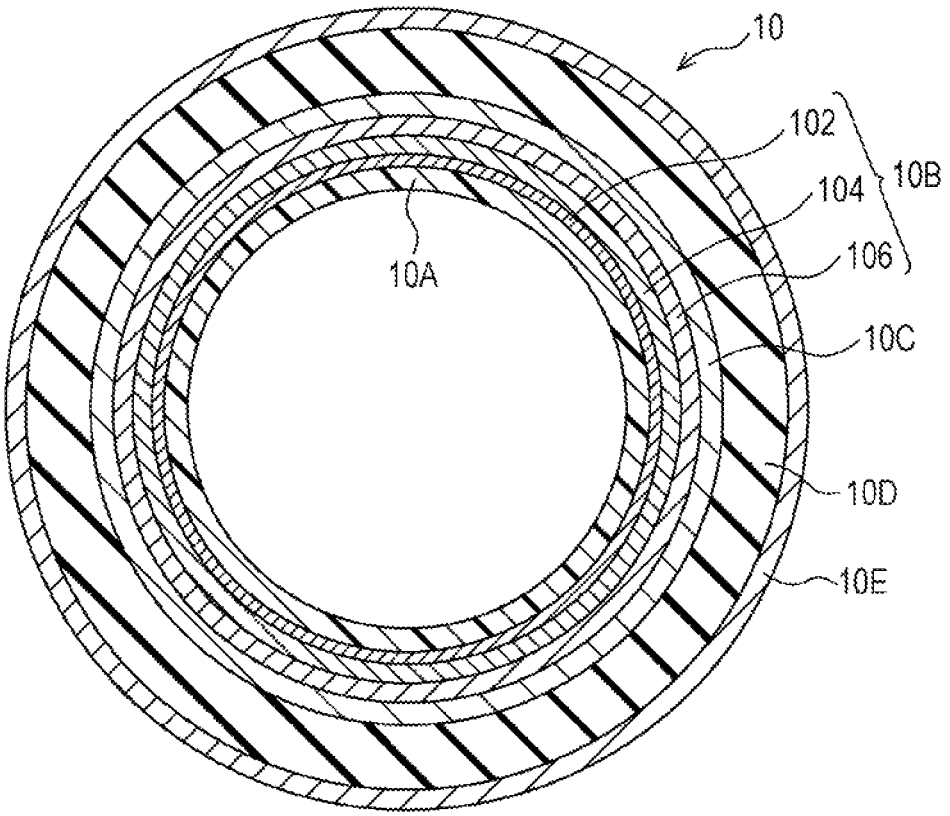
FIG. 1 is a schematic sectional view showing a layer configuration of an example of a fixing belt according to an exemplary embodiment of the present disclosure.

Exemplary embodiments of the present disclosure are described below.

[Fixing Belt]

A fixing belt according to an exemplary embodiment of the present disclosure includes an annular resin base layer having a water absorption rate of 3% or less, a metal layer provided on the outer peripheral surface of the resin base layer, and an elastic layer provided on the outer peripheral surface of the metal layer.

The fixing belt according to the exemplary embodiment of the present disclosure has the configuration described above and thus suppresses peeling between the resin base layer and the metal layer when toner images are repeatedly fixed after long-term storage in a high-temperature high-humidity environment (for example, 30° C. and 85% RH). The reason for this is supposed as follows.

In a fixing device in an electromagnetic induction heating system, at least a portion (for example, a metal heat-generating layer) of a metal layer of a fixing belt is heated by an electromagnetic induction device. Thus, a toner image is fixed to a recording medium by sandwiching the recording medium with an unfixed toner image formed on the surface between the heated fixing belt and a pressure member.

In the fixing device in an electromagnetic induction heating system, it is desired to increase the heating rate for attempting to shorten the time (also referred to as the "warm-up time" hereinafter) from the start of heating by the electromagnetic induction device until the surface of the fixing belt reaches a target temperature.

On the other hand, a fixing belt may be stored at a high temperature and high humidity. However, an ordinary fixing belt includes a resin base layer having a high water absorption rate (for example, exceeding 3%), and thus the resin base layer contains much water.

However, when the fixing belt including the resin base layer containing water is heated at a high heating rate (for example, 40° C./sec or more), the water interposed between the resin base layer and the metal layer is expanded by evaporation, decreasing the adhesion between the resin base layer and the metal layer. In particular, the metal layer does not transmit the vaporized water, and thus the adhesion is easily decreased.

In addition, repeated bending of the fixing belt during fixing of toner images may cause peeling at the interface between the resin base layer and the metal layer due to a decrease in the adhesion.

Therefore, when the water absorption rate of the resin base layer is suppressed to 3% or less, the resin base layer hardly contains water even by the storage of the fixing belt at a high temperature and high humidity. Thus, even when the fixing belt is heated at a high heating rate (for example, 40° C./sec or more), the adhesion between the resin base layer and the metal layer is suppressed due to the decreased amount of water interposed between the resin base layer and the metal layer.

Thus, it is supposed that the fixing belt according to the exemplary embodiment of the present disclosure suppresses peeling between the resin base layer and the metal layer when toner images are repeated fixed after long-term storage in a high-temperature high-humidity environment.

In addition, the fixing belt according to the exemplary embodiment of the present disclosure suppresses paper wrinkles or image defect caused by peeling between the resin base layer and the metal layer.

Details of the fixing belt according to the exemplary embodiment are described below by using the drawings.

FIG. 1 is a schematic configuration diagram showing an example of the fixing belt.

A fixing belt 10 shown in FIG. 1 is a fixing belt having a layer configuration in which for example, a metal layer 10B, an adhesive layer 10C, an elastic layer 10D, and a release layer 10E are laminated in order on the outer peripheral surface of an annular resin base layer 10A. The adhesive layer 10C and the release layer 10E are layers provided according to demand.

In addition, the metal layer 10B includes, for example, an underlaying metal layer 102, a metal heat-generating layer 104, and a metal protection layer 106, which are laminated in this order. The underlaying metal layer 102 is a layer provided according to demand. The metal heat-generating layer 104 is a layer which self-generates heat by an electromagnetic induction function when the fixing belt 10 is used in a fixing device in an electromagnetic induction system.

In addition, the fixing belt 10 according to the exemplary embodiment of the present disclosure is not limited to the structure described above and may further include another layer. In description below, the reference numeral of each of the layers may be omitted.

<Resin Base Layer 10A>

The resin base layer 10A (also simply referred to as the "base layer 10A" hereinafter) contains a resin as a principal component. The term "principally" or "principal component" represents that a ratio by weight is 50% or more, and the same applies below. The base layer 10A may contain a known additive other than the resin.

The content of the resin relative to the whole of the base layer 10A is, for example, 50% by mass or more, preferably 60% by mass or more, more preferably 70% by mass or more, still more preferably 78% by mass or more, and particularly preferably 90% by mass or more.

The water absorption rate of the resin base layer is 3% or less. From the viewpoint of suppressing peeling between the resin base layer and the metal layer when a toner image is repeatedly fixed after storage in a high temperature-humidity environment, the water absorption rate is preferably 2.5% or less and more preferably 2.3% or less. However, from the viewpoint of bending durability, the lower limit of water absorption rate is preferably 0.5% or more. That is, the water absorption rate is particularly preferably 0.5% or more and 2.3% or less.

The water absorption rate of the resin base layer is measured as follows.

A sample of the base layer to be measured is immersed in boiling hot water for 1 hour, and then the mass W1 of the water-absorbed sample of the base layer is measured.

Next, the water-absorbed sample of the base layer is dried at 120° C. for 2 hours, and then the mass W2 of the dried sample of the base layer is measured.

Then, the water absorption rate of the base layer is calculated by the following formula.

$$\text{Water absorption rate (\% by mass)} = (W1 - W2)/W2 \times 100$$

Examples of a method for adjusting the water absorption rate of the resin base layer within the range described above include the following methods.

1) A method of sufficiently increasing the imidization ratio by adding a sufficient amount of heat during formation of the base layer.

2) A method of sufficiently decreasing the content of the solvent or another component in the base layer.

3) A method of minimizing the decomposition reaction of an imide bond during lamination on the base layer.

The resin of the base layer 10A is preferably a heat-resistant resin.

Examples of the resin include heat-resistant resins with high heat resistance and high strength, such as polyimide, aromatic polyamide, liquid crystal materials such as thermotropic liquid crystal polymers and the like, and the like. Besides these, polyester, polyethylene terephthalate, polyether sulfone, polyether ketone, polysulfone, polyimide-amide, and the like can be used. Among these, polyimide is preferred.

In addition, the thermal insulation effect may be further improved by adding a filler having a thermal insulation effect to the resin or by foaming the resin.

Among these, from the viewpoint of heat resistance, a polyimide resin is preferred as the heat-resistant resin.

The polyimide resin is, for example, an imidized product of polyamic acid (precursor of the polyimide resin) which is a polymer of a tetracarboxylic dianhydride and a diamine compound. A specific example of the polyimide resin is a resin produced by imidizing polyamic acid in a polyamic acid solution prepared by polymerization reaction of equimolar amounts of tetracarboxylic dianhydride and a diamine compound in a solvent.

The tetracarboxylic dianhydride may be either an aromatic or aliphatic compound, but an aromatic compound is preferred from the viewpoint of heat resistance.

Examples of an aromatic tetracarboxylic dianhydride include pyromellitic dianhydride, 3,3',4,4'-benzophenonetetracarboxylic dianhydride, 3,3',4,4'-biphenylsulfonetetracarboxylic dianhydride, 1,4,5,8-naphthalenetetracarboxylic dianhydride, 2,3,6,7-naphthalenetetracarboxylic dianhydride, 3,3',4,4'-biphenylether tetracarboxylic dianhydride, 3,3',4,4'-dimethyldiphenylsilane tetracarboxylic dianhydride, 3,3',4,4'-tetraphenylsilane tetracarboxylic dianhydride, 1,2,3,4-furantetracarboxylic dianhydride, 4,4'-bis(3,4-dicarboxyphenoxy)diphenyl sulfide dianhydride, 4,4'-bis(3,4-dicarboxyphenoxy)diphenylsulfone dianhydride, 4,4'-bis(3,4-dicarboxyphenoxy)diphenylpropane dianhydride, 3,3',4,4'-perfluoroisopropylidene diphthalic dianhydride, 3,3',4,4'-biphenyltetracarboxylic dianhydride, 2,3,3',4'-biphenyltetracarboxylic dianhydride, bis(phthalic acid) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, bis(triphenylphthalic acid)-4,4'-diphenylmethane dianhydride, and the like.

Examples of an aliphatic tetracarboxylic dianhydride include aliphatic or alicyclic tetracarboxylic dianhydrides such as butanetetracarboxylic dianhydride, 1,2,3,4-cyclobutanetetracarboxylic dianhydride, 1,3-dimethyl-1,2,3,4-cyclobutanetetracarboxylic dianhydride, 1,2,3,4-cyclopentanetetracarboxylic dianhydride, 2,3,5-tricarboxycyclopentylacetic dianhydride, 3,5,6-tricarboxynorbornane-2-acetic dianhydride, 2,3,4,5-tetrahydrofurantetracarboxylic dianhydride, 5-(2,5-dioxotetahydrofuryl)-3-methyl-3-cyclohexene-1,2-dicarboxylic dianhydride, bicyclo[2,2,2]-oct-7-ene-2,3,5,6-tetracarboxylic dianhydride, and the like; aliphatic tetracarboxylic dianhydrides each having an aromatic ring, such as 1,3,3a,4,5,9b-hexahydro-2,5-dioxo-3-furanyl)-naphtho [1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, 1,3,3a,4,5,9b-hexahydro-8-methyl-5-(tetrahydro-2,5-dioxo-3-furanyl)-naphtho[1,2-c]furan-1,3-dione, and the like; and the like.

Among these, the aromatic tetracarboxylic dianhydride is preferred as the tetracarboxylic dianhydride, and, specifically, for example, pyromellitic dianhydride, 3,3',4,4'-biphenyltetracarboxylic dianhydride, 2,3,3',4'-biphenyltetracarboxylic dianhydride, 3,3',4,4'-biphenylether tetracarboxylic dianhydride, and 3,3',4,4'-benzophenone tetracarboxylic dianhydride are preferred, pyromellitic dianhydride, 3,3',4,4'-biphenyltetracarboxylic dianhydride, and 3,3',4,4'-benzophenone tetracarboxylic dianhydride are more preferred, and 3,3',4,4'-biphenyltetracarboxylic dianhydride is particularly preferred.

These tetracarboxylic dianhydrides may be used alone or in combination of two or more.

In the use of combination of two or more types, aromatic tetracarboxylic dianhydrides or aliphatic tetracarboxylic dianhydrides may be used in combination, or an aromatic tetracarboxylic dianhydride and an aliphatic tetracarboxylic dianhydride may be used in combination.

On the other hand, the diamine compound has two amino groups in its molecular structure. The diamine compound may be either an aromatic or aliphatic compound, but an aromatic compound is preferred.

Examples of the diamine compound include aromatic diamines such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene)bisaniline, 4,4'-(m-phenyleneisopropylidene)bisaniline, 2,2'-bis[4-(4-amino-2-trifluoromethylphenoxy)phenyl]hexafluoropropane, 4,4'-bis[4-(4-amino-2-trifluoromethyl)phenoxy]-octafluorobiphenyl, and the like; aromatic diamines such as diaminotetraphenylthiophene and the like, each having two amino groups bonded to an aromatic ring and a heteroatom other than the nitrogen atoms of the amino groups; aliphatic diamines and alicyclic diamines such as 1,1-meta-xylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyclopentadienylene diamine, hexahydro-4,7-metanoindanylene dimethylene diamine, tricyclo [6,2,1,$0^{2,7}$]-undecylene dimethyldiamine, 4,4'-methylene bis(cyclohexylamine), and the like; and the like.

Among these, the diamine compound is preferably an aromatic diamine compound, and specifically, for example, p-phenylenediamine, m-phenylenediamine, 4,4'-diaminodiphenylmethane, 4,4'-diaminodiphenyl ether, 3,4'-diaminodiphenyl ether, 4,4'-diaminodiphenyl sulfide, and 4,4'-diaminodiphenyl sulfone are preferred, and 4,4'-diaminodiphenyl ether and p-phenylenediamine are particularly preferred.

These diamine compounds may be used alone or in combination of two or more. In the use of combination of two or more, aromatic diamine compounds or aliphatic diamine compounds may be used in combination, or an aromatic diamine compound and an aliphatic diamine compound may be used in combination.

Among these, from the viewpoint of heat resistance, the polyimide resin is preferably an aromatic polyimide resin (an imidized product of polyamic acid (precursor of the polyimide resin) which is a polymer of an aromatic tetracarboxylic dianhydride and an aromatic diamine compound). That is, the base layer 10A is preferably a base layer containing the aromatic polyimide resin.

The aromatic polyimide resin is more preferably a polyimide resin having a structural unit represented by the following general formula (PI1).

(PI1)

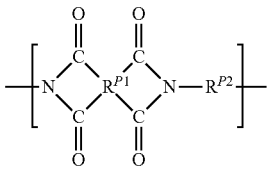

In the general formula, $R^{P1}$ represents a phenyl group or a biphenyl group, and $R^{P2}$ represents a divalent aromatic group.

Examples of a divalent aromatic group represented by $R^{P2}$ includes a phenylene group, a naphthyl group, a biphenyl group, a diphenyl ether group, and the like. From the viewpoint of bending durability, the divalent aromatic group is preferably a phenylene group or a biphenyl group.

The number-average molecular weight of the polyimide resin is preferably 5,000 or more and 100,000 or less, more preferably 7,000 or more and 50,000 or less, and still more preferably 10,000 or more and 30,000 or less.

The number-average molecular weight of the polyimide resin is measured by gel permeation chromatography (GPC) under the following measurement conditions.

Column: Tosoh TSK gel α-M (7.8 mm I. D×30 cm)

Eluent: DMF (dimethylformamide)/30 mM LiBr/60 mM phosphoric acid

Flow rate: 0.6 mL/min

Injection amount: 60 μL

Detector: RI (differential refractive index detector)

The base layer 10A may contain known additives such as a conductive agent, a filler, a lubricant, etc. other than the resin.

Base Layer

The thickness of the base layer 10A is, for example, preferably 20 μm or more and 200 μm or less, more preferably 30 μm or more and 150 μm or less, and still more preferably 40 μm or more and 130 μm or less.

In addition, the outer peripheral surface of the base layer 10A may be previously treated (roughening treatment) for roughening the surface so as to facilitate the adhesion of metal particles when the underlaying metal layer 102 is formed. Examples of the roughening treatment include sand blasting with alumina abrasive grains or the like, cutting, sandpapering, and the like.

<Underlaying Metal Layer 102>

The underlaying metal layer 102 is a layer previously formed for forming the metal heat-generating layer 104 on the outer peripheral surface of the base layer 10A by an electroplating method and is provided according to demand. A method for forming the metal heat-generating layer 104 is preferably an electroplating method from the viewpoint of cost and the like, but when the base layer 10A principally composed of a resin is used, direct electroplating is difficult. Therefore, the underlaying metal layer 102 is preferably provided for forming the metal heat-generating layer 104.

Examples of the method for forming the underlaying metal layer 102 on the outer peripheral surface of the base layer 10A include an electroless plating method, a sputtering method, a vapor deposition method, and the like, and a chemical plating method (electroless plating method) is preferred from the viewpoint of easy film formation.

Examples of the underlaying metal layer 102 include an electroless nickel-plating layer, an electroless copper-plating layer, and the like. The "nickel-plating layer" represents a plating layer (for example, a nickel layer, a nickel alloy layer, or the like) containing Ni, and the "copper plating layer" represents a plating layer (for example, a copper layer, a copper alloy layer, or the like) containing Cu.

The thickness of the underlaying metal layer 102 is preferably within a range of 0.1 μm or more and 5 μm or less and more preferably within a range of 0.3 μm or more and 3 μm or less.

The thickness of each of the layers constituting the fixing belt 10 is a value obtained by measuring the thickness in an image formed by observing a section in each of the circumferential direction and the axial direction of the belt cylinder using a scanning electron microscope ("JSM6700F" manufactured by JEOL Ltd.) at an acceleration voltage of 2.0 kV and a magnification of 5000 times.

<Metal Heat-Generating Layer 104>

The metal heat-generating layer 104 is a heat-generating layer having the function of generating heat by the eddy current produced in the layer when a magnetic field is applied, and is composed of a metal which causes an electromagnetic induction function.

Examples of the metal which causes an electromagnetic induction function include single metals such as nickel, iron, copper, gold, silver, aluminum, chromium, tin, zinc, and the like; and alloys each containing two or more types of metals. In view of cost, heating performance, and processability, copper, nickel, aluminum, iron, and chromium are suitable, and among these, copper or an alloy containing copper as a principal component is particularly preferred.

The metal heat-generating layer 104 is formed by a known method, for example, electroplating treatment.

Although the optimum thickness of the metal heat-generating layer 104 varies with its metal material, for example, when copper is used for the metal heat-generating layer 104, from the viewpoint of efficient heat generation, the thickness of the metal heat-generating layer 104 is preferably within a range of 3 μm or more and 50 μm or less, more preferably within a range of 3 μm or more and 30 μm or less, and still more preferably within a range of 5 μm or more and 20 μm or less.

<Metal Protection Layer 106>

The metal protection layer 106 is provided in contact with the metal heat-generating layer 104 in order to improve the film strength of the metal heat-generating layer 104, suppress cracking due to repeated deformation and oxidative deterioration or the like due to repeated heating for a long time, and maintain heat generation characteristics.

The metal protection layer 106 preferably has a thin film with high breaking strength and high durability and oxidation resistance, and is preferably composed of an oxidation-resistant metal. Specifically, the metal protection layer 106 preferably contains, for example, copper or nickel, and from the viewpoint of suppressing the occurrence of cracking due to repeated deformation and oxidative deterioration or the like due to repeated heating, it particularly preferably contains nickel (or a nickel alloy), which is an oxidation-resistant metal.

Although the optimum thickness of the metal protection layer 106 varies with its material, for example, when nickel is used for forming the metal protection layer 106, the thickness of the metal protection layer 106 is preferably within a range of 2 μm or more and 20 μm or less, more preferably within a range of 2 μm or more and 15 μm or less, and still more preferably within a range of 5 μm or more and 10 μm or less.

In view of processability of a thin film, the metal protection layer 106 is preferably formed by an electroplating method, and nickel electroplating with high strength is particularly preferred.

In the case of forming by the electroplating method, first a plating solution containing metal ions such as nickel ions or the like is prepared, and the base layer 10A having the underlaying metal layer 102 and the metal heat-generating layer 104 is immersed in the plating solution to form an electroplating layer having a desired thickness by electroplating.

<Adhesive Layer 10C>

If required, from the viewpoint of improving adhesion between a layer (in FIG. 1, the metal protection layer 106) constituting the outer peripheral surface of the metal layer 10B and the elastic layer 10D, the adhesive layer 10C may be interposed between both layers.

In addition, from the viewpoint of thermal conductivity or the like, the adhesive layer 10C is generally provided as a thin-film layer (for example, 1 μm or less). From the viewpoint of easy formation of the adhesive layer, the thickness of the adhesive layer 10C is preferably 0.1 μm or more and 1 μm or less and more preferably 0.2 μm or more and 0.5 μm or less.

The adhesive used in the adhesive layer 10C preferably causes no change in physical properties even in a state where the adjacent metal layer 10B generates heat and has excellent heat conductivity to the outer peripheral surface side. Examples thereof include a silane coupling agent-based adhesive, a silicone-base adhesive, an epoxy resin-based adhesive, a urethane resin-based adhesive, and the like.

The adhesive layer 10C may be formed by applying a known method, and, for example, it may be formed by applying a coating solution for forming an adhesive layer on the metal layer 10B by a coating method. The coating solution for forming an adhesive layer may be prepared by a known method, and, for example, may be prepared by mixing and stirring an adhesive with, if required, a solvent, Specifically, for example, an adhesive film is first formed by applying (for example, applying by a flow coating method (helical winding coating method)) and then, if required, drying and heating the coating solution for forming an adhesive layer on the metal layer 10B. The drying temperature for drying is, for example, 10° C. or more and 35° C. or less, and the drying time is, for example, 10 minutes or more and 360 minutes or less. Also, the heating temperature for heating is, for example, within a range of 100° C. or more and 200° C. or less, and the heating time is, for example, 10 minutes or more and 360 minutes or less. The heating may be performed in an inert gas (for example, nitrogen gas, argon gas, or the like) atmosphere.

<Elastic Layer 10D>

The elastic layer 10D is not particularly limited as long as it is a layer having elasticity.

The elastic layer 10D is provided from the viewpoint of imparting elasticity to the pressure applied to the fixing belt 10 from the outer peripheral side, and plays the role of adhering the surface of the fixing belt to a toner image, following unevenness of the toner image on a recording medium.

The elastic layer 10D is preferably composed of, for example, an elastic material which restores to its original shape even when deformed by applying an external pressure of 100 Pa.

Examples of the elastic material used for the elastic layer 10D include a fluorocarbon resin, a silicone resin, a silicone rubber, fluorocarbon rubber, fluorosilicone rubber, and the like. From the viewpoint of heat resistance, thermal conductivity, insulation, etc., the material of the elastic layer is preferably silicone rubber or fluorocarbon rubber and more preferably silicone rubber.

Examples of the silicone rubber include RTV silicone rubber, HTV silicone rubber, liquid silicone rubber, and the like, and specific examples thereof include polydimethyl silicone rubber (MQ), methylvinyl silicone rubber (VMQ), methylphenyl silicone rubber (PMQ), fluorosilicone rubber (FVMQ), and the like.

Examples of silicone rubber commercial products include liquid silicone rubber SE6744 manufactured by Dow Corning Corporation and the like.

The silicone rubber preferably principally has an addition reaction-type cross-linkage form. Also, various types of functional groups are known in the silicone rubber, and dimethyl silicone rubber having a methyl group, methylphenyl silicone rubber having a methyl group and a phenyl group, vinyl silicone rubber (vinyl group-containing silicone rubber) having a vinyl group, and the like are preferred. Among these, vinyl silicone rubber having a vinyl group is more preferred, and silicone rubber having an organopolysiloxane structure having a vinyl group and a hydrogen organopolysiloxane structure having a hydrogen atom (SiH) bonded to a silicon atom is more preferred.

Examples of fluorocarbon rubber include vinylidene fluoride-based rubber, tetrafluoroethylene/propylene-based rubber, tetrafluoroethylene/perfluoromethyl vinyl ether rubber, phosphagen-based rubber, fluoropolyether, and the like.

Examples of fluorocarbon rubber commercial products include Viton B-202 manufactured by DuPont Dow Elastomers Inc. and the like.

The elastic material used for the elastic layer 10D preferably contains silicone rubber as a principal component (that is, contains at a mass ratio of 50% or more), and the content thereof is more preferably 90% by mass or more and still more preferably 99% by mass or more.

Besides the elastic material, the elastic layer 10D may further contain an inorganic filler for the purpose of reinforcement, heat resistance, heat conduction, and the like. Preferred examples of the inorganic filler include known fillers such as fumed silica, crystalline silica, iron oxide, alumina, metal silicon, and the like.

Examples of a material of the inorganic filler include, besides the above, known inorganic fillers such as carbides (for example, carbon black, carbon fibers, carbon nanotubes, and the like), titanium oxide, silicon carbide, talc, mica, kaolin, calcium carbonate, calcium silicate, magnesium oxide, graphite, silicon nitride, boron nitride, cerium oxide, magnesium carbonate, and the like.

Among these, from the viewpoint of thermal conductivity, silicon nitride, silicon carbide, graphite, boron nitride, carbides are preferred.

The content of the inorganic filler in the elastic layer 10D may be determined according to the desired thermal conductivity, mechanical strength, etc. and is, for example, 1% by mass or more and 20% by mass or less, preferably 3% by mass or more 15% by mass or less, and more preferably 5% by mass or more and 10% by mass or less.

In addition, the elastic layer 10D may contain as additives, for example, a softener (paraffin-based or the like), a processing aid (stearic acid or the like), an antioxidant (amine-based or the like), a vulcanizing agent (sulfur, a metal oxide, peroxide, or the like), a functional filler (alumina or the like), etc.

The thickness of the elastic layer 10D is, for example, within a range of 30 μm or more and 600 μm or less, and preferably within a range of 100 μm or more and 500 μm or less.

The elastic layer 10D may be formed by applying a known method and, for example, may be formed on the adhesive layer 10C by a coating method.

When silicone rubber is used as the elastic material of the elastic layer 10D, for example, first a coating solution for forming an elastic layer, which contains liquid silicone rubber changed to silicone rubber by heat-curing, is prepared. Next, the coating solution for forming an elastic layer is applied (for example, applied by a flow coating method (helical winding coating)) on the adhesive film formed by applying and drying the coating solution for an adhesive layer, forming an elastic film. For example, if required, the elastic film is vulcanized to form an elastic layer on the adhesive layer. The vulcanization temperature for vulcanization is, for example, 150° C. or more and 250° C. or less, and the vulcanization time is, for example, 30 minutes or more and 120 minutes or less.

<Release Layer 10E>

The release layer 10E is a layer playing the role of suppressing the fixing of a toner image in a melt state to the surface (outer peripheral surface) on the side in contact with a recording medium during fixing. The release layer is provided according to demand.

The release layer 10E is required to have, for example, heat resistance and releasability. From this viewpoint, a heat-resistant releasing material is preferably used as a material constituting the release layer, and specific examples thereof include fluorocarbon rubber, a fluorocarbon resin, a silicone resin, a polyimide resin, and the like.

Among these, a fluorocarbon resin is preferred as the heat-resistant releasing material.

Examples of the fluorocarbon resin include tetrafluoroethylene-perfluoroalkyl vinyl ether copolymer (PFA), polytetrafluoroethylene (PTFE), tetrafluoroethylene-hexafluoropropylene copolymer (FEP), polyethylene-tetrafluoroethylene copolymer (ETFE), polyvinylidene fluoride (PVDF), polychloro-trifluoroethylene (PCTFE), vinyl fluoride (PVF), and the like.

The elastic layer-side surface of the release layer may be surface-treated. The surface treatment may be either wet treatment or dry treatment, and examples thereof include liquid ammonia treatment, excimer laser treatment, plasma treatment, and the like.

The thickness of the release layer 10E is preferably within a range of 10 μm or more and 100 μm or less and more preferably within a range of 20 μm or more and 50 μm or less.

The release layer 10E may be formed by applying a known method and, for example, may be formed by a coating method.

Also, the release layer 10E may be formed by previously preparing a tube-shaped release layer, forming an adhesive layer, for example, on the inner surface of the tube, and then coating the outer periphery of the elastic layer 10D with the tube.

<Fixing Device>

A fixing device according to an exemplary embodiment of the present disclosure includes the fixing belt according to the exemplary embodiment described above, a pressure member which presses the outer peripheral surface of the fixing belt and sandwiches a recording medium having an unfixed toner image formed on the surface thereof together with the fixing belt, and an electromagnetic induction device which allows at least a portion (specifically, the metal heat-generating layer) of the metal layer of the fixing belt to generate heat by electromagnetic induction.

An example of the fixing device according to the exemplary embodiment is described below, but the fixing device is not limited to this.

Figure 2:
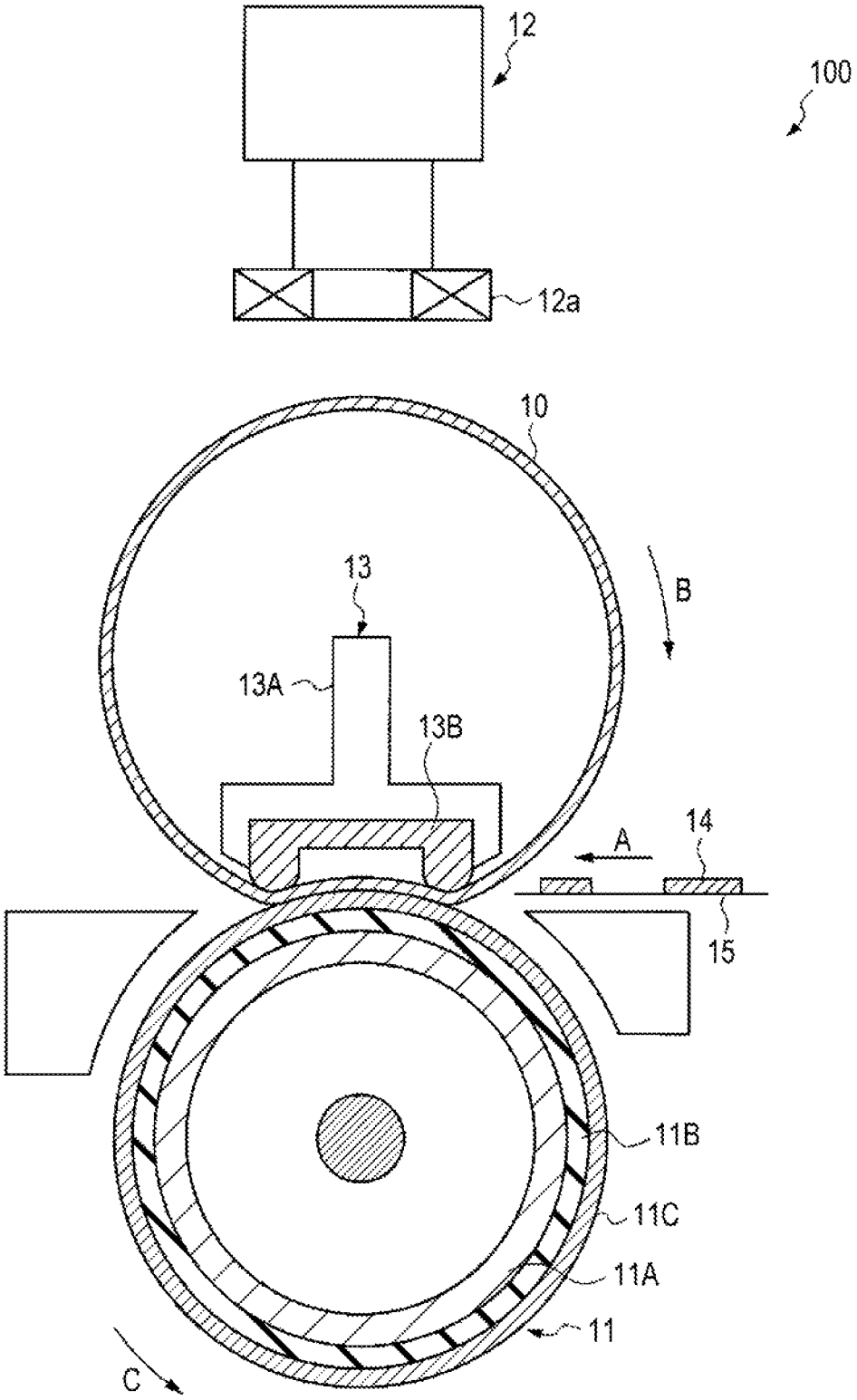
FIG. 2 is a schematic configuration diagram showing an example of a fixing device according to an exemplary embodiment of the present disclosure.

FIG. 2 is a schematic configuration diagram showing an example of the fixing device according to the exemplary embodiment of the present disclosure.

A fixing device 100 according to the exemplary embodiment of the present disclosure is fixing device in an electromagnetic induction system provided with the fixing belt according to the exemplary embodiment. As shown in FIG. 2, a pressure roller (pressure member) 11 is disposed so as to press a portion of the fixing belt 10 to form a contact region (nip) between the fixing belt 10 and the pressure roller 11 from the viewpoint of efficiently fixing, and the fixing belt 10 is curved along the form of the peripheral surface of the pressure roller 11. In addition, from the viewpoint of securing releasability of the recording medium, a bent portion where the fixing belt 10 is bent is formed at an end of the contact region (nip).

The pressure roller 11 may be configured by forming an elastic layer 11B on a substrate 11A by using silicone rubber or the like, and forming a release layer 11C on the elastic layer 11B by using a fluorine-based compound.

In addition, a counter member 13 is disposed at a position inside the fixing belt 10 so as to face the pressure roller 11. The counter member 13 has a pad 13B which is made of a metal, a heat-resistant resin, heat-resistant rubber, or the like and which comes in contact with the inner peripheral surface of the fixing belt 10 to locally increase pressure, and a support 13A which supports the pad 13B.

Further, an electromagnetic induction heating device 12 with a built-in electromagnetic induction coil (exciting coil) 12*a* is provided at a position facing the pressure roller 11 (an example of the pressure member) with the fixing belt 10 as the center. In the electromagnetic induction heating device (electromagnetic induction device) 12, an alternating current is applied to the electromagnetic induction coil to change the generated magnetic field by an excitation circuit, and an eddy current is generated in the metal layer 10B (particularly, the metal heat-generating layer 104 in the fixing belt with the configuration shown in FIG. 1). The eddy current is converted to heat (Joule heat) by the electrical resistance of the metal layer 10B, and as a result, the surface of the fixing belt 10 generates heat.

In addition, the position of the electromagnetic induction heating device 12 is not limited to the position shown in FIG. 2, and for example, the device 12 may be installed on the upstream side of the contact region of the fixing belt 10 in the rotation direction B or may be installed on the inside of the fixing belt 10.

In the fixing device 100 according to the exemplary embodiment of the present disclosure, the fixing belt 10 self-rotates in the arrow B direction by transmission of driving force to a gear fixed at the end of the fixing belt 10 by a driving device, and the pressure roller 11 rotates in the reverse direction, that is, the arrow C direction, with the rotation of the fixing belt 10.

The recording medium 15 having an unfixed toner image formed thereon is passed in the arrow A direction through the contact region (nip) between the fixing belt 10 and the pressure roller 11 in the fixing device 100, and the unfixed toner image 14 in a melt state is fixed to the recording medium 15 by applying pressure.

Herein, in the fixing device 100 according to the exemplary embodiment of the present disclosure, the heating rate of the surface of the fixing belt by the electromagnetic induction device is, for example, 40° C./sec or more (preferably 50° C./sec or more and 60° C./sec or less) from 25° C. to 120° C.

When the fixing belt is heated at a high heating rate of 40° C./sec or more (preferably 50° C./sec or more and 60° C./sec or less), peeling between the resin base layer and the metal layer easily occurs due to the water contained in the resin base layer.

However, by using the fixing belt according to the exemplary embodiment of the present disclosure, peeling between the resin base layer and the metal layer is suppressed even by heating the fixing belt at a high heating rate.

<Image Forming Apparatus>

An image forming apparatus according to an exemplary embodiment of the present disclosure includes an image holding member, a charging device which charges the surface of the image holding member, an electrostatic latent image forming device which forms an electrostatic latent image on the charged surface of the image holding member, a developing device which develops the electrostatic latent image formed on the surface of the image holding member with a toner to form a toner image, a transfer device which transfers the toner image formed on the surface of the image holding member to a recording medium, and the fixing device according to the exemplary embodiment of the present disclosure which fixes the toner image to the recording medium.

Figure 3:
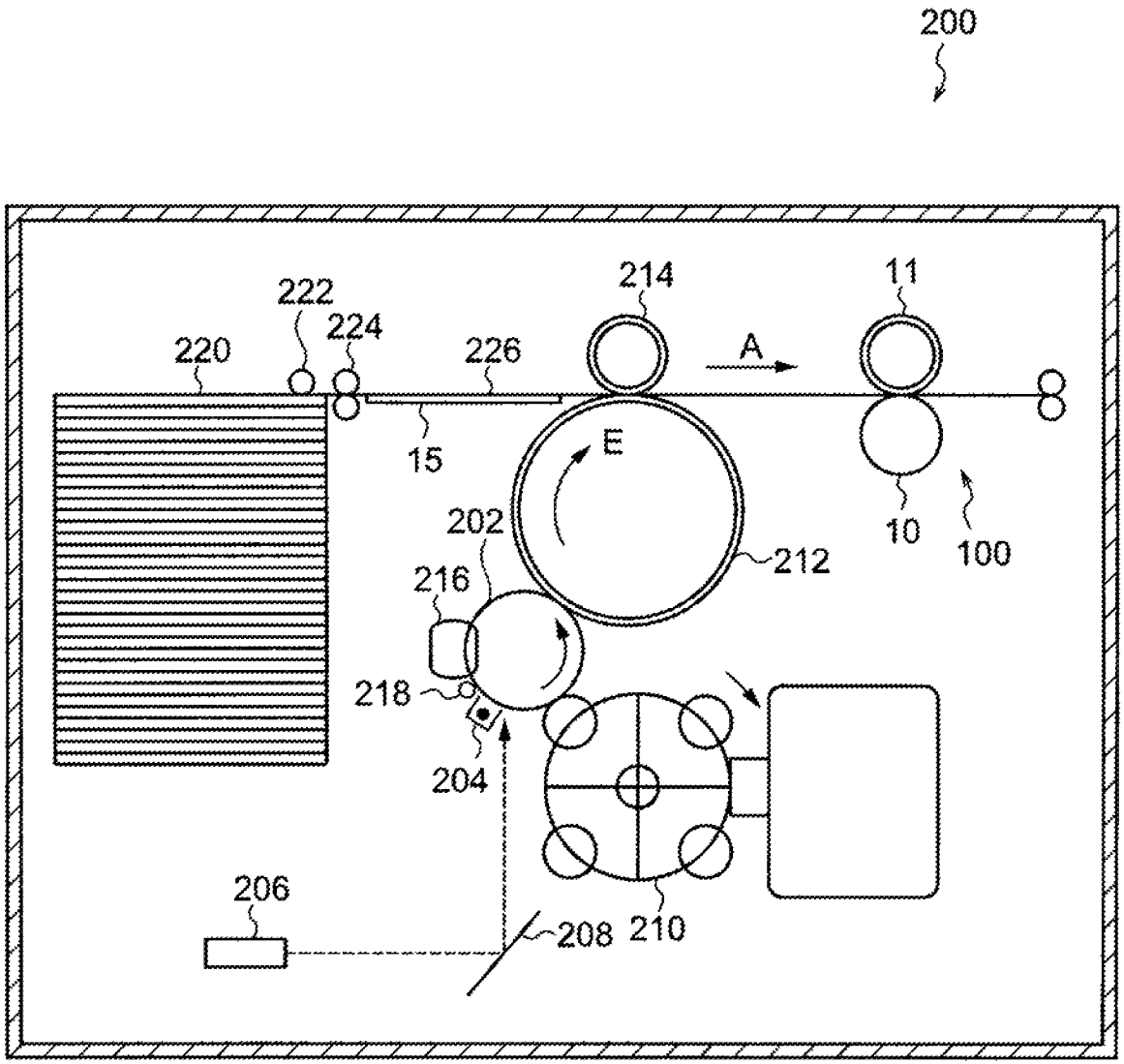
FIG. 3 is a schematic configuration diagram showing an example of an image forming apparatus according to an exemplary embodiment of the present disclosure.

FIG. 3 is a schematic configuration diagram showing an example of the image forming apparatus according to the exemplary embodiment of the present disclosure.

As shown in FIG. 3, an image forming apparatus 200 according to the exemplary embodiment of the present disclosure includes a photoreceptor (an example of the image holding member) 202, a charging device 204, a laser exposure device (an example of the latent image forming device) 206, a mirror 208, a developing device 210, an intermediate transfer body 212, a transfer roller (an example of the transfer device) 214, a cleaning device 216, a static elimination device 218, a fixing device 100, and a paper feed device (a paper feed unit 220), a paper feed roller 222, a registration roller 224, and a recording medium guide 226).

In forming an image by the image forming apparatus 200, first the surface of the photoreceptor 202 is charged by the non-contact charging device 204 provided near the photoreceptor 202.

The surface of the photoreceptor 202 charged by the charging device 204 is irradiated with laser light corresponding to image information (signal) of each color from the laser exposure device 206 through the mirror 208, forming an electrostatic latent image.

The developing device 210 forms a toner image by applying a toner to the latent image formed on the surface of the photoreceptor 202. The developing device 210 includes developing units of respective colors (not shown) which house toners of the respective four colors: cyan, magenta, yellow, and black. When the developing device 210 is rotated in an arrow direction, a toner of each of the colors is applied to the latent image formed on the surface of the photoreceptor 202, forming a toner image.

In the contact part between the photoreceptor 202 and the intermediate transfer body 212, the toner images of the respective colors formed on the surface of the photoreceptor 202 are superposed and transferred to the outer peripheral surface of the intermediate transfer body 212 by the bias voltage applied between the photoreceptor 202 and the intermediate transfer body 212 so that the toner image of each of the colors corresponds to image information.

The intermediate transfer body 212 whose outer peripheral surface is in contact with the surface of the photoreceptor 202 is rotated in the arrow E direction.

Besides the photoreceptor 202, the transfer roller 214 is provided around the intermediate transfer body 212.

The intermediate transfer body 212 to which the toner images of the respective colors have been transferred is rotated in the arrow E direction. In the contact part between the transfer roller 214 and the intermediate transfer body 212, the toner images on the intermediate transfer body 212 are transferred to the surface of the recording medium 15 transported to the contact part in the arrow A direction by the paper feed device.

In feeding paper to the contact part between the intermediate transfer body 212 and the transfer roller 214, the recording medium housed in the paper feed unit 220 is pushed up to a position in contact with the paper feed roller 222 by a recording medium push-up unit (not shown) built in the paper feed unit 220, and when the recording medium 15 comes in contact with the paper feed roller 222, the paper feed roller 222 and the registration roller 224 are rotated to transport the recording medium 15 along the recording medium guide 226 in the arrow A direction.

The toner images transferred to the surface of the recording medium 15 are moved in the arrow A direction, and in the contact region (nip) between the fixing belt 10 and the pressure roller 11, the toner images 14 in a melt state are pressed on the surface of the recording medium 15 and fixed to the surface of the recording medium 15. Therefore, an image fixed to the surface of the recording medium is formed.

After the toner images are transferred to the surface of the intermediate transfer body 212, the surface of the photoreceptor 202 is cleaned by the cleaning device 216.

After the surface of the photoreceptor 202 is cleaned by the cleaning device 216, static elimination is performed by the static elimination device 218.

EXAMPLES

The present disclosure is described in further detail below by giving examples. However, the present disclosure in not limited to the examples below.

Example 1

(Polyimide Resin Base Layer)

A precursor coating material of polyimide resin configured by a repeating unit represented by a structural formula (PI) below is applied on the surface of a cylindrical stainless mold having an outer diameter of 30 mm and then imidized by firing at 390° C. for 60 minutes. The resultant polyimide film is separated from the surface of the stainless mold to form an endless belt-like polyimide resin base layer having an inner diameter of 30 mm, a film thickness of 60 μm, and a length of 390 mm.

(PI)

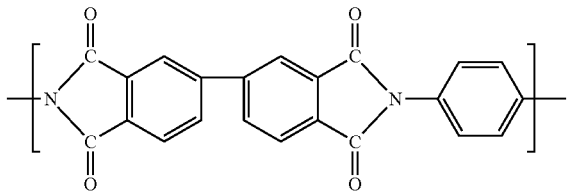

(Pretreatment)

After blast treatment, the polyimide base layer of 60 μm is immersed in an aqueous sodium hydroxide solution adjusted to pH 11 at a temperature of 5° C. for 5 minutes.

(Formation of Metal Layer)

Next, an electroless nickel plating layer having a thickness of 0.3 μm as an underlaying metal layer, a copper electroplating layer of 10 μm as a metal heat-generating layer, and a nickel plating layer of 10 μm as a metal protection layer are formed in order on the outer peripheral surface of the polyimide resin base layer.

(Formation of Elastic Layer)

Next, liquid silicone rubber (X34-1053, manufactured by Shin-Etsu Chemical Co., Ltd.) is applied on the outer peripheral surface of the resultant layers so that the thickness is 200 μm, and then cured at 110° C. for 15 minutes, forming an elastic layer.

(Formation of Release Layer)

Next, a fluorocarbon resin tube is molded by injection molding by using PFA (451HP-J, manufactured by DuPont-Mitsui Fluorochemicals Co., Ltd.) as a raw material.

Next, the inner surface of the fluorocarbon resin tube is plasma-treated. The fluorocarbon resin tube is placed on the elastic layer and heated at 200° C. for 4 hours to form a release layer including the fluorocarbon resin tube.

A fixing belt is produced through the process described above.

Example 2

Before pretreatment, a polyimide resin base layer is further heated at 300° C. for 1 hour, and next in the pretreatment, the blast-treated polyimide base layer of 60 μm is immersed, at a temperature of 50° C. for 5 minutes, in an aqueous sodium hydroxide solution adjusted to pH 11. Excepting this, a fixing belt is produced by the same method as in Example 1.

Comparative Example 1

In pretreatment, a blast-treated polyimide base layer of 60 μm is immersed, at a temperature of 60° C. for 10 minutes, in an aqueous sodium hydroxide solution adjusted to pH 11. Excepting this, a fixing belt is produced by the same method as in Example 1.

<Measurement of Water Absorption Rate>

The water absorption rate of the fixing belt of each of the examples is measured by the method described above.

<Evaluation of Image Formation>

The fixing belt of each of the examples is stored in an environment at 95° C. and 100% RH for 96 hours.

Each of the fixing belts after storage is mounted on a fixing device of an image forming apparatus, "DocuCentre-IV C5571" (manufactured by Fuji Xerox Co., Ltd.)".

However, the fixing device is adjusted so that the heating rate of the surface of the fixing belt from room temperature (25° C.) to 120° C. is 50° C./min.

By using the image forming apparatus, a half-tone image with an image density of 50% is output on 10 sheets of A4 paper (Ncolor 081, weight 81 g/m$^2$).

With respect to the output images, the presence of image quality defect or wrinkles and the presence of peeling at the interface between the base layer and the metal layer of the fixing belt are visually observed. The evaluation is made according to the following criteria.

A: No occurrence of peeling at the interface and image quality defect/wrinkles

B: Occurrence of peeling at the interface and image quality defect/wrinkles

TABLE 1

| | Example 1 | Example 2 | Cornparative Example 1 |
|---|---|---|---|
| Water absorption rate of polyimide resin base layer (%) | 2.5 | 2.2 | 3.3 |
| Evaluation of image formation (presence of peeling at interface and presence of image defect/wrinkles) | A | A | B |

The results indicate that the fixing belt of each of the examples suppresses peeling at the interface and the occurrence of image defect or wrinkles as compared with the fixing belt of the comparative example.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing belt comprising:

an annular resin base layer having a water absorption rate of 3% or less;

a metal layer provided on an outer peripheral surface of the resin base layer; and an elastic layer provided on an outer peripheral surface of the metal layer, wherein the annular resin base layer is obtained by:

forming an annular resin base film, and immersing the annular resin base film in an aqueous sodium hydroxide solution, wherein the water absorption rate is determined by:

immersing a sample of the base layer in the boiling water for 1 hour to obtain a water-absorbed sample, and then measuring a mass W1 the water-absorbed sample;

drying the water-absorbed sample at 120° C. for 2 hours to obtain a dried sample, and then measuring a mass W2 of the dried sample; and calculating the water absorption rate by the following formula:

$$\text{Water absorption rate (\% by mass)}=(W1-W2)/W2\times 100.$$

2. The fixing belt according to claim 1, wherein a water absorption rate of the resin base layer is 2.5% or less.

3. The fixing belt according to claim 2, wherein the water absorption rate of the resin base layer is 0.5% or more and 2.3% or less.

4. The fixing belt according to claim 1, wherein the resin base layer is a base layer containing an aromatic polyimide resin.

5. The fixing belt according to claim 4, wherein the aromatic polyimide resin is a polyimide resin having a structural unit represented by general formula (PI1) below, (PI1)

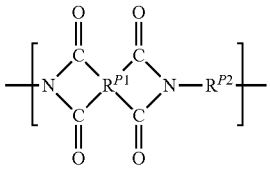

(in the general formula, $R^{P1}$ represents a phenyl group or a biphenyl group, and $R^{P2}$ represents a divalent organic group).

6. The fixing belt according to claim 1, wherein a thickness of the resin base layer is 20 μm or more and 200 μm or less.

7. The fixing belt according to claim 6, wherein the thickness of the resin base layer is 30 μm or more and 150 μm or less.

8. The fixing belt according to claim 7, wherein the thickness of the resin base layer is 40 μm or more and 130 μm or less.

9. The fixing belt according to claim 1, wherein the metal layer has an underlaying metal layer provided on the outer peripheral surface of the resin base layer, a metal heat-generating layer provided on the outer peripheral surface of the underlaying metal layer, and a metal protection layer provided on the outer peripheral surface of the metal heat-generating layer.

10. A fixing device comprising:

the fixing belt according to claim 1;

a pressure member that presses an outer peripheral surface of the fixing belt; and an electromagnetic induction device that allows at least a portion of the metal layer of the fixing belt to generate heat by electromagnetic induction, wherein a recording medium with an unfixed toner image formed on a surface thereof is held between the fixing belt and the pressure member, thereby fixing the toner image to the recording medium.

11. The fixing device according to claim 10, wherein a heating rate of the surface of the fixing belt by the electromagnetic induction device is 40° C./sec or more from 25° C. to 120° C.

12. The fixing device according to claim 11, wherein the heating rate is 50° C./sec or more and 60° C./sec or less.

13. An image forming apparatus comprising:

an image holding member;

a charging device that charges a surface of the image holding member;

an electrostatic latent image forming device that forms an electrostatic latent image on the charged surface of the image holding member;

a developing device that develops the electrostatic latent image formed on the surface of the image holding member with a toner to form a toner image;

a transfer device that transfers the toner image formed on the surface of the image holding member to a recording medium; and the fixing device according to claim 10 that fixes the toner image to the recording medium.

* * * * *